US010220625B2

(12) United States Patent
Lebron et al.

(10) Patent No.: US 10,220,625 B2
(45) Date of Patent: Mar. 5, 2019

(54) LIQUID CONTAINER

(71) Applicant: Hewlett-Packard Development Company, L.P., Houston, TX (US)

(72) Inventors: Hector Lebron, San Diego, CA (US); Juan A. Marrero Cosme, Aguadilla, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/520,350

(22) PCT Filed: Apr. 23, 2015

(86) PCT No.: PCT/US2015/027286

§ 371 (c)(1),
(2) Date: Apr. 19, 2017

(87) PCT Pub. No.: WO2016/171698

PCT Pub. Date: Oct. 27, 2016

(65) Prior Publication Data

US 2017/0326881 A1 Nov. 16, 2017

(51) Int. Cl.

| | |
|---|---|
| ***B41J 2/175*** | (2006.01) |
| ***B65D 30/22*** | (2006.01) |
| ***B41J 2/18*** | (2006.01) |

(52) U.S. Cl.

CPC ..... *B41J 2/175* (2013.01); *B41J 2/17513* (2013.01); *B41J 2/18* (2013.01); *B65D 31/12* (2013.01); *B41J 2002/17516* (2013.01); *B65D 2217/02* (2013.01)

(58) Field of Classification Search

CPC ..... B41J 2/175; B41J 2/17513; B41J 2002/17516; B65D 31/12; B65D 2217/02

USPC ..... 347/93

See application file for complete search history.

(56) References Cited

U.S. PATENT DOCUMENTS

| | | | |
|---|---|---|---|
| 5,138,332 | A | 8/1992 | Carlotta |
| 6,257,712 | B1 | 7/2001 | Haigo |
| 7,311,389 | B1 | 12/2007 | Pidgeon |
| 8,517,522 | B2 | 8/2013 | Bibl |
| 8,939,564 | B2 | 1/2015 | Igawa |

(Continued)

FOREIGN PATENT DOCUMENTS

| | | |
|---|---|---|
| CN | 102615982 | 8/2012 |
| EP | 0636018 | 2/1995 |

(Continued)

OTHER PUBLICATIONS

Exceed Your Imagination 3D Texture, 3D Lenticular, PixelJet UV-Flatbed Printer Series, Jul. 8, 2011, 6 pages, http://ww.monotech.in/media/pdf/pixeljetUV-flatbed-printer.pdf.

(Continued)

*Primary Examiner* — Huan Tran
*Assistant Examiner* — Alexander D Shenderov
(74) *Attorney, Agent, or Firm* — Dierker & Kavanaugh PC

(57) ABSTRACT

In one example, a liquid container includes an expandable and collapsible bag having a first interior chamber and a second interior chamber separated by a barrier; a passage through the barrier for liquid to pass between the chambers; a first opening between the first chamber and an exterior of the bag; and a second opening between the second chamber and the exterior of the bag.

7 Claims, 5 Drawing Sheets

(56) References Cited

U.S. PATENT DOCUMENTS

| | | | | |
|---|---|---|---|---|
| 2003/0156766 | A1* | 8/2003 | Stefandl | B65D 77/283 383/9 |
| 2004/0100540 | A1 | 5/2004 | Hatasa et al. | |
| 2004/0134802 | A1* | 7/2004 | Inoue | A61J 1/2093 206/219 |
| 2004/0243094 | A1 | 12/2004 | Dumon D'Ayot et al. | |
| 2007/0029001 | A1* | 2/2007 | Trouilly | A61J 1/2093 141/114 |
| 2007/0285474 | A1* | 12/2007 | Murakami | B41J 2/175 347/85 |
| 2009/0295881 | A1 | 12/2009 | Tasaka et al. | |
| 2012/0200619 | A1* | 8/2012 | Bibl | B41J 2/17513 347/6 |

FOREIGN PATENT DOCUMENTS

| | | |
|---|---|---|
| EP | 2093065 | 8/2009 |
| EP | 2808044 | 12/2014 |
| JP | H11198393 | 7/1999 |
| JP | 2005246854 | 9/2005 |
| JP | 2006027617 | 2/2006 |
| JP | 2011156859 | 8/2011 |

OTHER PUBLICATIONS

PCT International Search Report and Written Opinion, dated Dec. 1, 2015, PCT Application No. PCT/US2015/027286, Korean Intellectual Property Office, 12 pages.

* cited by examiner

LIQUID CONTAINER

BACKGROUND

In some inkjet printers, inks and other printing liquids are supplied to the printhead through a collapsible bag. The supply bag may be integral to the printhead or separate from the printhead. In printers that consume a lot of ink, for example, large ink supply bags are usually housed at a location remote from the printheads. This is particularly true for scanning type inkjet printers in which it is not practical to carry large ink supplies on the carriage along with the printheads.

DRAWINGS

Figure 8:
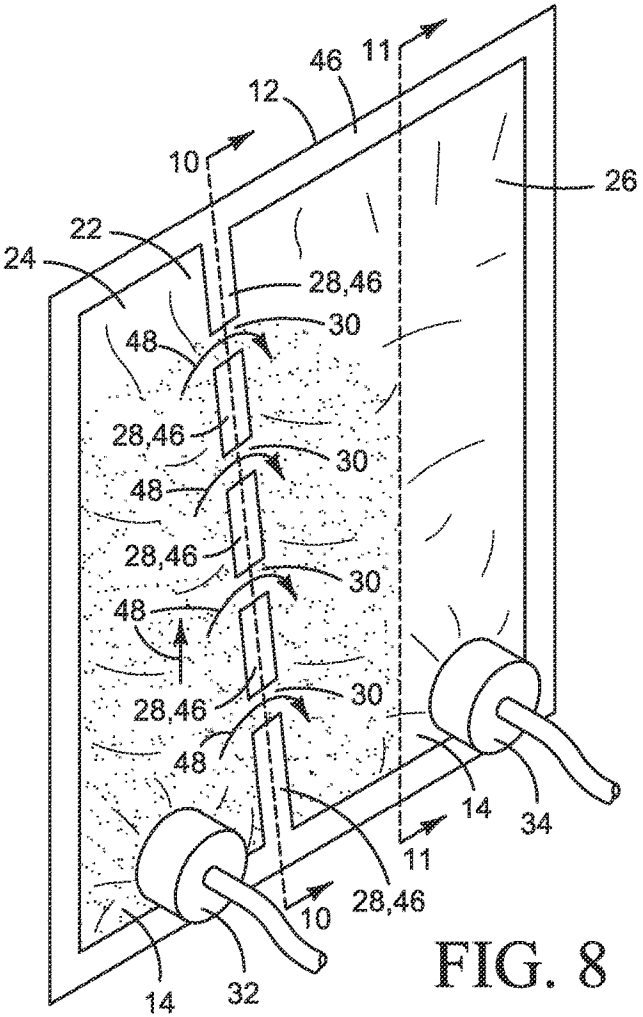
Figure 10:
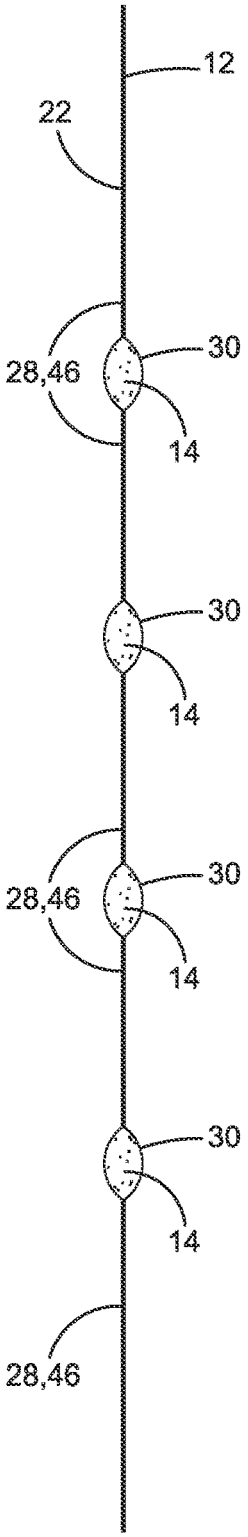
Figure 11:
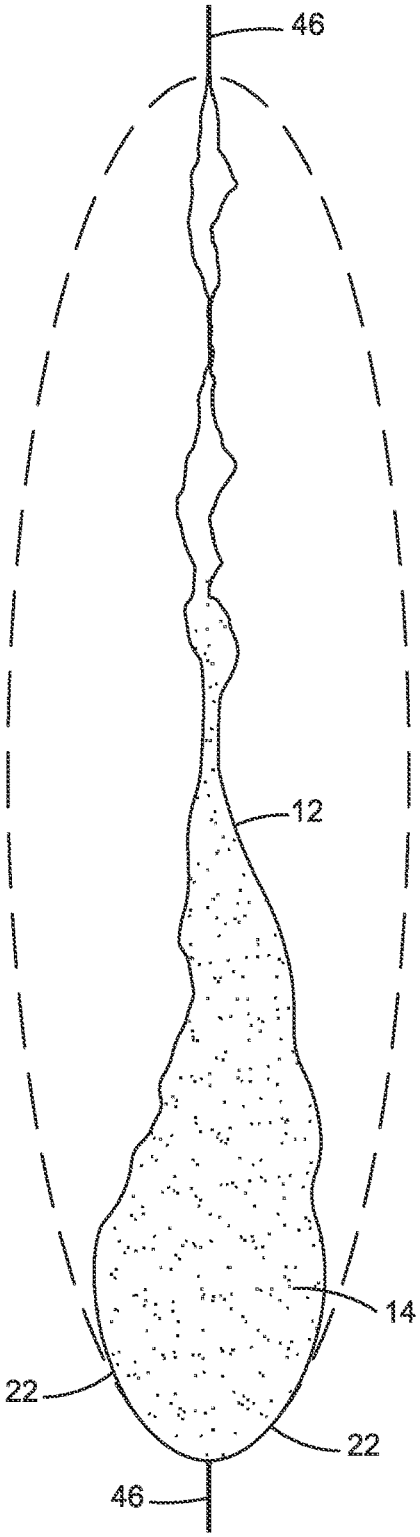

FIGS. 10 and 11 are example sections taken along the lines 10-10 and 11-11 in FIG. 8, respectively.

The same part numbers designate the same or similar parts throughout the figures. The figures are not necessarily to scale.

DESCRIPTION

Some types of printing liquids include components that do not stay dissolved or suspended as long as desired for normal printing. For example, the pigments in white ink and magnetic ink tend to precipitate if the ink is not mixed frequently. A new container for ink and other printing liquids has been developed to enhance mixing for a more stable liquid and, thus, better printing. In one example, the container includes an expandable and collapsible bag with multiple interior chambers separated by a barrier. A passage or multiple passages through the barrier allow liquid to pass from one chamber into another chamber to promote mixing. In one example, liquid is pumped into a narrower chamber that functions primarily as a flow chamber to channel flow more quickly to a broader chamber that functions primarily as a mixing chamber where the liquid flows more slowly. The bag may be constructed of a crinkly material that forms an irregular surface topography when it collapses. As liquid is removed from the mixing chamber to supply a printhead for printing, the crinkly bag material collapses to form wrinkles, creases and crevices that promote mixing when liquid is pumped back into the chamber during recirculation.

Examples are not limited to containers for holding ink and other printing liquids, but may also include containers for other liquids and/or for uses other than printing. The examples shown in the figures and described herein illustrate but do not limit the scope of the patent, which is defined in the Claims following this Description.

As used in this document, "crinkly" means an expandable and contractible material that forms an irregular surface topography when not taut; a "liquid" means a fluid not composed primarily of a gas or gases; a "printing liquid" means a liquid that may be dispensed by an inkjet printer or other inkjet type dispenser; and "air free" means the surface of the liquid is not exposed to air but that the liquid itself may contain air bubbles.

Figure 1:
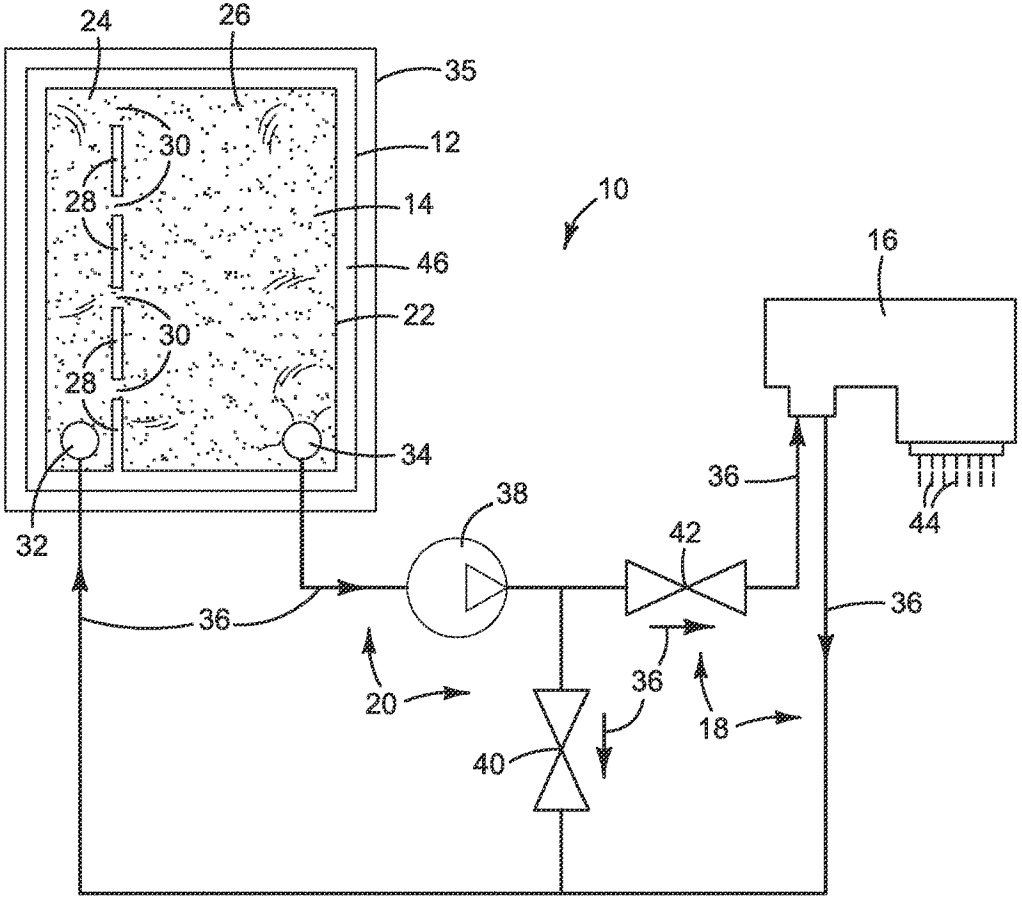
FIG. 1 illustrates a liquid delivery system implementing one example of a container to supply printing liquid to a printhead or other inkjet type dispenser.

FIG. 1 illustrates a liquid delivery system 10 implementing one example of a container 12 to supply printing liquid 14 to a printhead or other inkjet type dispenser 16. Referring to FIG. 1, system 10 includes container 12, a supply path 18, and a bypass path 20. Container 12 is constructed as a collapsible bag 22 with multiple chambers 24, 26 separated by a barrier 28. Each chamber 24, 26 defines an interior volume to hold liquid 14. Passages 30 through barrier 28 allow liquid 14 to pass between chambers 24 and 26. Container 12 also includes an opening 32, 34 between each interior chamber 24, 26 and an exterior of the container (paths 18 and 20 in this example). Each opening 32, 34 usually will be implemented as a valve or other suitable airtight and liquid-tight connector that allows liquid 14 to flow out of and into chambers 24, 26 without leaking liquid from or introducing air into either chamber 24, 26. If desired, liquid container 12 may be enclosed in a box 35.

In the example shown in FIG. 1, liquid 14 flows from chamber 26 through an outlet 34 along flow paths 18, 20 to chamber 24 through an inlet 32, as indicated by arrows 36. Flow paths 18, 20 share a pump 38 that moves liquid 14 through system 10. Control valves 40, 42 are opened and closed to direct the flow of liquid 12 to the desired path 18, 20 or to direct liquid 12 simultaneously to both flow paths 18 and 20. During printing, valve 40 may be closed and valve 42 open so that liquid 14 flows only along supply path 18 to dispenser 16 where some of liquid 14 may be dispensed, for example as drops or streams 44, and back to container 12 at inlet 32. When not printing, valve 40 may be open and valve 42 closed so that liquid 14 flows only along bypass path 20. Although a pump 38 is shown, liquid 14 may be made to flow along paths 18 and 20 under the influence of gravity alone.

Liquid 14 is depicted by stippling in the figures. Bag 22 is transparent in the figures so that interior features are not obscured by the bag material. An opaque bag 22 could be used. For example, air tight and ink resistant metallized, multi-layer materials may be used to form an ink supply bag 22. The exterior of bag 22 is depicted by contour lines in the figures. Bag 22 may be constructed, for example, by welding or otherwise joining together sheets of flexible bag material along perimeter seams 46 and along barrier 28 so that the interior volumes between the sheets can expand and contract as liquid moves in and out of chambers 24, 26. Other suitable constructions for bag 22 are possible.

FIGS. 2-5 are elevations illustrating various examples of a barrier 28 and the corresponding flow path through container 12. Flow through the interior of container 12 is indicated by arrows 48. FIGS. 6-7 and 8-9 are isometrics illustrating a container 12 at different stages of liquid moving along the flow paths shown in FIGS. 2 and 3, respectively.

Figure 2:
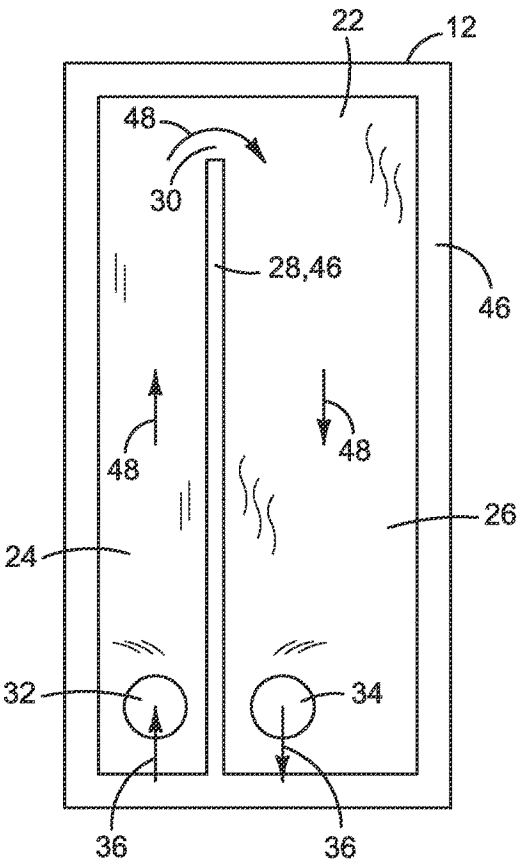

Referring first to FIG. 2, in this example liquid moves from a narrower, smaller volume inlet chamber 24 to a broader, larger volume outlet chamber 26 through a single passage 30 in barrier 28. Inlet 32 and outlet 34 are positioned at one end of the respective chamber 24, 26 and passage 30 is positioned at the opposite end of each chamber 24, 26. Again, as noted above, inlet 32 and outlet 34 may be implemented as sealed connections that allow liquid 14 to flow into chamber 24 and out of chamber 26 without leaking liquid or introducing air into either chamber 24, 26.

In the configuration shown in FIG. 2, the narrower, smaller volume inlet chamber 24 functions primarily as a flow chamber to channel liquid to the broader, larger outlet chamber 26 that functions primarily as a mixing chamber. A smaller, faster flowing inlet chamber 24 as shown in FIG. 2 may be desirable in some implementations to help the recirculation flow path fill more quickly at the start of a mixing cycle and to shrink the volume of liquid in the system not held in outlet chamber 26. In addition, locating a single passage 30 opposite inlet 32 and outlet 34 enhances mixing by maximizing the distance the liquid flows through the interior of bag 22 from inlet 32 to outlet 34.

Figure 3:
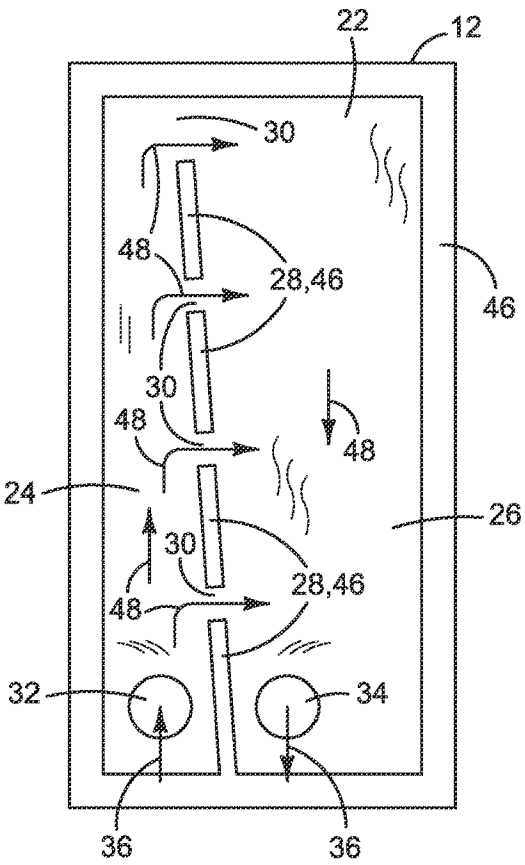

Referring now to the example shown in FIG. 3, multiple passages 30 along barrier 28 distribute the flow lengthwise between chambers 24 and 26. Multiple passages 30 allow liquid to pass more easily from chamber 24 to chamber 26 even as the total volume of liquid in the system decreases and bag 22 collapses, for example as ink is consumed during printing. Also in this example, inlet chamber 24 is tapered from a broader region near inlet 32 to a narrower region away from inlet 32 to help distribute liquid 14 more evenly to passages 30 along the length of barrier 28.

Figure 4:
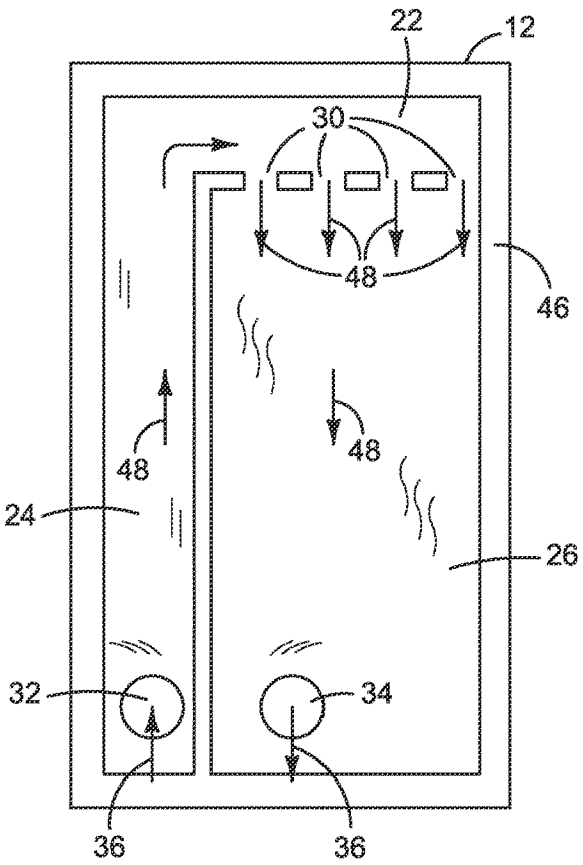

In the example shown in FIG. 4, an L shaped barrier 28 with multiple passages 30 along the crosswise part of barrier 28 distribute the flow laterally across one end of outlet chamber 26. The configuration shown in FIG. 4 may be desirable, for example, to distribute the flow more evenly across a wider outlet chamber 26.

Figure 5:
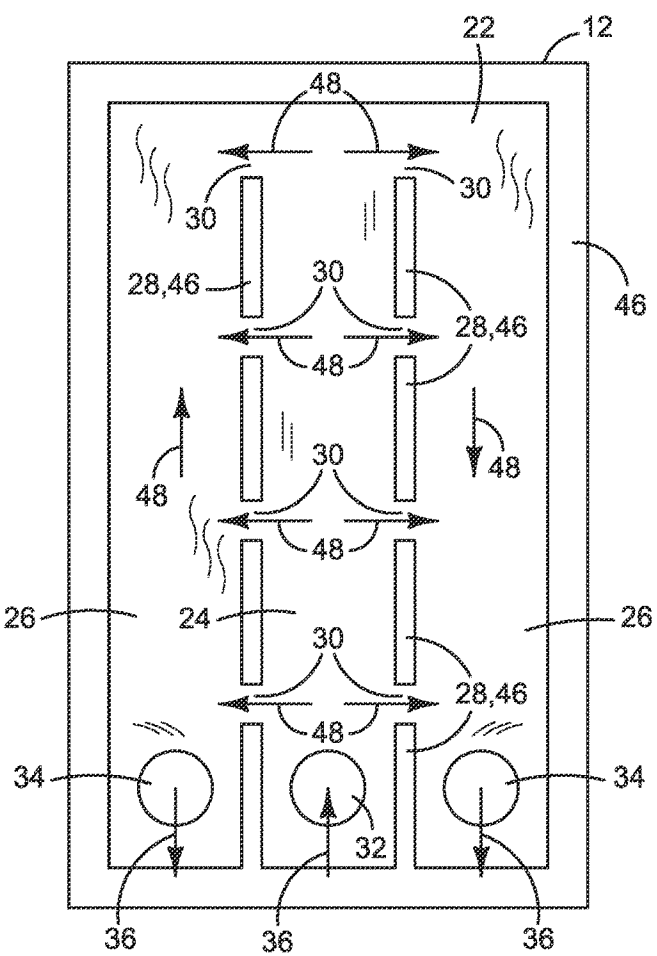
FIGS. 2-5 illustrate examples of barrier configurations and the corresponding flow path through a collapsible bag container, such as might be used for the printing liquid container in the delivery system shown in FIG. 1.

In the example shown in FIG. 5, bag 22 defines three interior chambers 24 and 26. In this example, liquid flows from a central inlet chamber 24 into two outlet chambers 26 through multiple passages 30 distributed along the length of barriers 28.

The number, size, spacing and/or location of passages 30 may vary from that shown in the examples of FIGS. 2-5 to achieve the desired flow characteristics. Also, while it is expected that a liquid container 12 usually will be oriented vertically during operation, with openings 32, 34 at the bottom of each chamber 24, 26 as shown, other operating orientations are possible.

Figure 7:
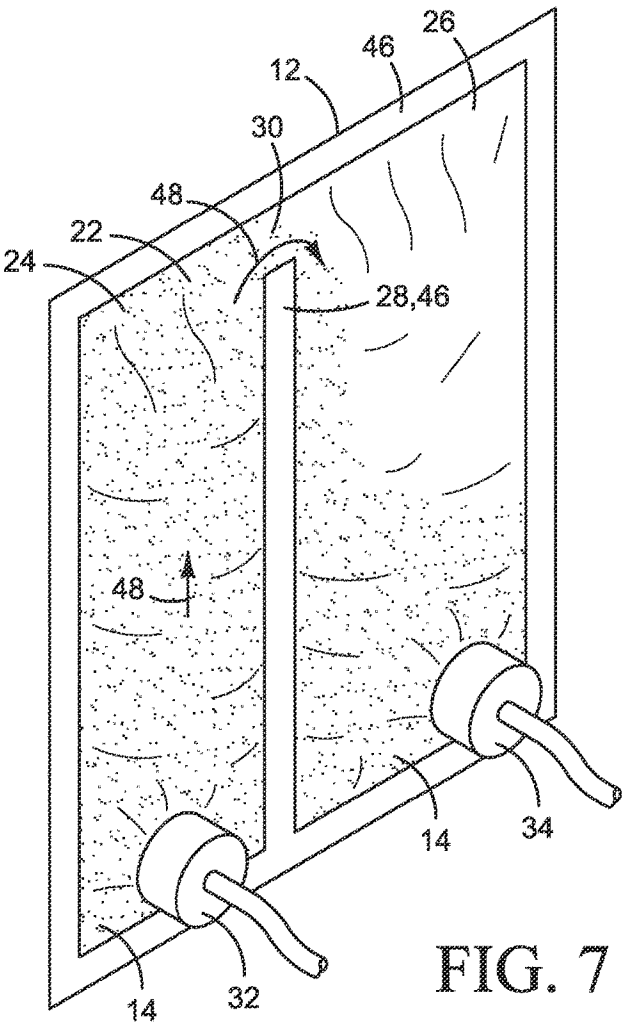
FIGS. 6 and 7 are isometrics illustrating one example of the container of FIG. 2 at different stages of liquid moving along interior flow paths.
Figure 6:
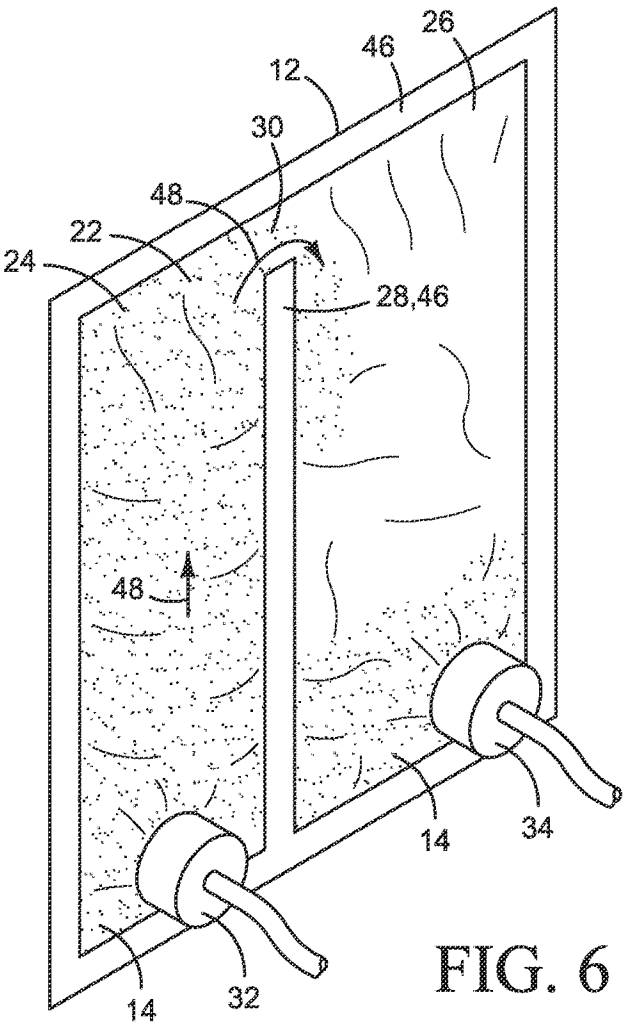

FIGS. 6 and 7 illustrate a container 12 in the configuration of FIG. 2 at different stages of recirculating a liquid 14 into bag 22. FIG. 6 shows bag 22 at a stage of recirculation when liquid 14 has filled inlet chamber 24 and is flowing into outlet chamber 26, but the flow has not yet reached a volume of liquid 14 remaining in chamber 26 near outlet 34. At this stage, the part of bag 22 defining outlet chamber 26 is partially collapsed into those regions where the original full volume of liquid 14 has been depleted, for example to supply dispenser 16 in FIG. 1. The collapsed bag forms an irregular topography with creases, crevices and wrinkles, which are represented by wavey contour lines in FIG. 6.

FIG. 7 shows bag 22 at a stage of recirculation when some of the recirculated liquid 14 has accumulated in outlet chamber 26. At this stage, recirculated liquid 14 has flowed through some of the irregular topography of the partially collapsed bag to promote mixing with the liquid.

Figure 9:
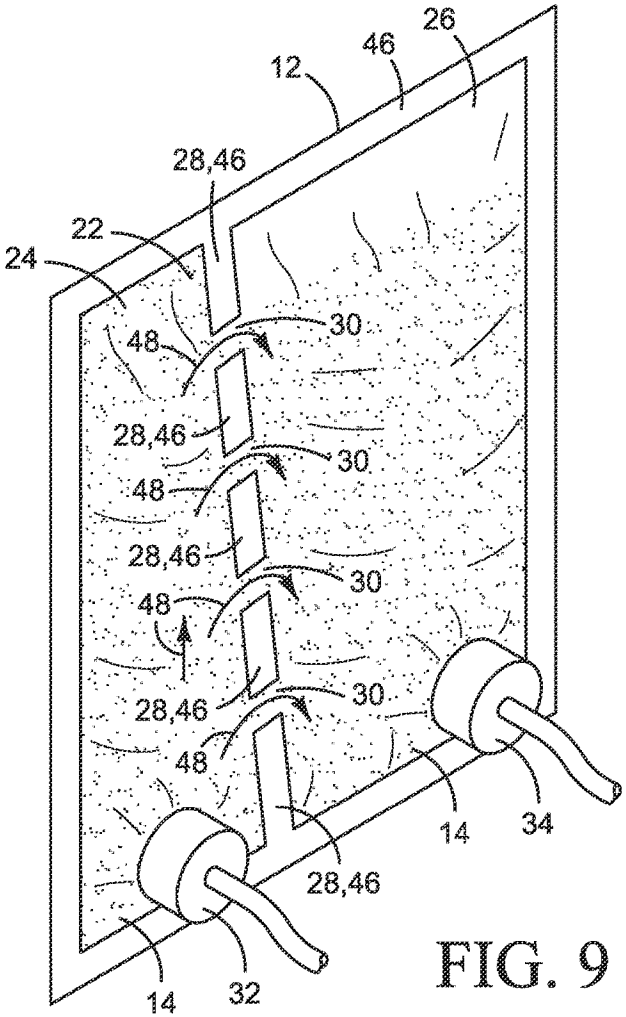
FIGS. 8 and 9 are isometrics illustrating one example of the container of FIG. 3 at different stages of liquid moving along interior flow paths.

FIGS. 8 and 9 illustrate a container 12 in the configuration of FIG. 3 at different stages recirculating a liquid 14 into bag 22. FIGS. 10 and 11 are sections taken along the lines 10-10 and 11-11 in FIG. 8. FIGS. 8, 10 and 11 show bag 22 at a stage of recirculation when liquid 14 is flowing through multiple passages 30 to refill outlet chamber 26. At this stage, the part of bag 22 defining outlet chamber 26 is partially collapsed into those regions where the original full volume of liquid 14 has been depleted. The collapsed bag forms an irregular topography with creases, crevices and wrinkles, as best seen in the section of FIG. 11. (The outline of a fully expanded bag 22 is shown by dashed lines in FIG. 11.) FIG. 9 shows bag 22 at a stage of recirculation when both chambers 24 and 26 are nearly full, for example when recirculating ink from a full or near full supply bag back to the bag through bypass path 20 (FIG. 1).

Bag 22 may be constructed of a crinkly material that forms an irregular surface topography when it collapses. As liquid is removed from outlet chamber 26, for example to supply a printhead for printing or during recirculation, the crinkly bag material collapses to form wrinkles and creases and crevices that promote mixing when liquid flows back into the chamber. For bags to contain ink and other printing liquids, the bag material should be impermeable to both air and printing liquid. A multi-layer construction may be used to construct a bag 22 with the desired degree of impermeability. Also, for ink and other printing liquids, bag 22 may be evacuated of all air to form air free interior volumes 24, 26 to minimize the risk of introducing damaging air bubbles into a printing system.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

"A" and "an" as used in the Claims means at least one.

What is claimed is:

1. An ink delivery system to supply ink to an in inkjet printhead, comprising:
- an ink supply bag including:
  - an air tight, ink resistant crinkly bag defining a flow chamber, a mixing chamber, an ink passage through which ink may flow from the flow chamber to the mixing chamber, and a barrier between the flow chamber and the mixing chamber to block the flow of ink from the flow chamber to the mixing chamber except through the passage;
  - an inlet to the flow chamber; and
  - an outlet from the mixing chamber;
- a supply path to carry ink from the outlet to the printhead and from the printhead to the inlet; and
- a pump to pump ink:
  - from the flow chamber to the mixing chamber through the passage;
  - from the outlet to the printhead; and
  - from the printhead to the inlet.

2. The system of claim 1, including ink in the flow chamber and in the mixing chamber and where the flow chamber and the mixing chamber are both air free.

3. The system of claim 1, where the passage comprises multiple passages through the barrier.

4. The system of claim 3, where the outlet is located near one end of the mixing chamber and the multiple passages extend along one side of the mixing chamber extending from the outlet end.

5. The system of claim 3, where the outlet is located near one end of the mixing chamber and the multiple passages extend across the other end of the mixing chamber opposite the outlet.

6. The system of claim 1, comprising:
- a bypass path to carry ink from the outlet to the inlet bypassing the printhead;
- a valve operable between a first position to allow ink to flow along only the supply path, a second position to allow ink to flow along only the bypass path, and a third position to allow ink to flow along both the supply path and the bypass path;

and where the pump is to pump ink along the supply path and/or the bypass path as allowed by the valve.

7. The system of claim 6, where the valve includes:

a first valve operable between an open position to allow ink to flow to the printhead along the supply path and a closed position to block the flow of ink to the printhead along the supply path; and a second valve operable between an open position to allow ink to flow to the inlet along the bypass path and a closed position to block the flow of ink to the inlet along the bypass path.

* * * * *